United States Patent [19]

Ralston et al.

[11] 4,064,992

[45] Dec. 27, 1977

[54] SPACESAVER TILTABLE STORAGE UNIT

[76] Inventors: John Pershing Ralston, 633 Pumosa Drive, Vista, Calif. 92083; Warren Huntsman Turpin, deceased, late of Huntington Beach, Calif.; by Lola Turpin, legal representative, 16411 Rhone Lane, Huntington Beach, Calif. 92647

[21] Appl. No.: 609,570

[22] Filed: Sept. 2, 1975

[51] Int. Cl.[2] ..... A47B 73/00

[52] U.S. Cl. ..... 211/75; 211/81

[58] Field of Search ..... 211/74, 72, 73, 81, 211/150, 75; 248/242; 312/327, 328, 120; 403/98

[56] References Cited

U.S. PATENT DOCUMENTS

| | | | |
|---|---|---|---|
| 447,532 | 3/1891 | Bacon | 312/328 X |
| 760,725 | 5/1904 | Bonsall | 312/327 |
| 846,553 | 3/1907 | Cummins | 211/74 X |
| 1,244,474 | 10/1917 | Cowles | 312/328 X |
| 2,408,460 | 10/1946 | Van Doren | 312/328 X |
| 2,532,604 | 12/1950 | Carski | 211/74 |
| 3,109,084 | 10/1963 | Walsh | 211/74 X |
| 3,351,210 | 11/1967 | Murcott | 211/74 |
| 3,467,259 | 9/1969 | Silver | 211/74 |

FOREIGN PATENT DOCUMENTS

| | | | |
|---|---|---|---|
| 1,218,584 | 5/1960 | France | 211/81 |

*Primary Examiner*—Roy D. Frazier
*Assistant Examiner*—Robert W. Gibson, Jr.
*Attorney, Agent, or Firm*—Harold C. Weston

[57] ABSTRACT

A spacesaver tiltable storage unit is disclosed comprised of a pivotable frame, with dimensions compatible for mounting between exposed 2 inch × 4 inch or 2 inch × 6 inch studs on 16 inch centers and fitted with storage elements for containment of small parts and components. Such a device as proposed here provides a means for storage space saving and efficient use of such common expendables as 1-pound coffee cans or a variety of food jars, each of which has its own removable top for dust-free storage of small parts. The frame is pivoted into the recess between exposed studs when not in use, and is held in the closed or recessed position through gravity, by reason of the center of mass of stored parts and components being positioned, in the storage elements, aft of the pivot line of the unit. The frame is fitted with motionrestraint means to limit its range of angular travel and storage elements of a variety of types, such as empty cans, jars or specially designed protective adaptable to the device herein described. Access to the storage elements is readily achieved by tilting the frame out of its stored or recessed position into its maximum arc position. After use, the storage elements are secured and the frame pivoted back into the recess between the supporting structure.

1 Claim, 8 Drawing Figures

SPACESAVER TILTABLE STORAGE UNIT

BACKGROUND OF THE INVENTION

1. Field of the Invention

This invention relates to improvements in tiltable storage units and, more particularly, to those used for storage of small parts such as nails, nuts, bolts and small components where any number of storage units can be built into spaces between vertical studs of work areas, which spaces were formerly unusable for anything other than fixed shelving.

2. Description of the Prior Art.

A variety of storage means are presently available commercially, ranging from rotary bins to hinged containers to tiltable racks for compact storage of units requiring frequent access for removal or placement of stored items.

Certain devices are presently in use which have pivotable bases and open tops, wherein small components are stored and protected by snap-lock lids which fit over the open tops until acess to the device contents is desired. The device is then unsnapped from its top, pivoted forward and contents accessed through the top.

Other pivotable storage devices are designed for tack mounting and use so that when access to the contents of the device is desired, it is pivoted forward and gravity feeds the device contents out from a curved surface backing and access slot near the top of the device. For storage, the device is moved to its original position at which the weight of the device's contents holds it fixed, this weight being massed below the pivot line of the device.

An older device is in use wherein covered boxes are mounted on tiltable shelves of a storage rack, and the shelves are tilted forward when access to the boxes thereon is desired. This device also utilizes the weight of the box contents to hold the tiltable shelf in its storage or secured position when the boxes are not being accessed.

The above-described units are generally useable in most situations and can be affixed to walls or surfaces convenient to use areas. Simple modification of the first two devices described can provide for limited travel of the pivotable devices to preclude accidental discharge of total contents of the devices, and modifications to the third device mentioned could be made to fit it into the special spaces, such as the 2 inch × 4 inch or 2 inch × 6 inch frame which this device utilizies. Each of them, however, has drawbacks in lack of versatility of use and in special mounting configurations required. None is designed specifically for ease of access to components, maximum utilization of "waste" space in work areas, and variation of device capacity or stored component character. As a result of the above defects, or of combinations thereof, most modern home-shop workers resort to fixed bin storage of such items as nails or bolts or electronic components, frequently resorting to use of fixed shelves between garage studs and storage of miscellany in cans, jars or plastic containers from household surplus with dust covers and adaptability to shelf storage.

OBJECTS OF THE INVENTION

In view of the above, it is an object of this invention to provide a storage unit usable for containment of small components or hardware items, mountable in and usable from presently unused space near work areas such as that space between vertical studs of work shop structure, easily accessed, compactly stored, and of low cost to the home-shop worker.

It is a further object of this invention to provide dust-free storage of small components and hardware in a smoothly operated array of storage elements wherein there is minimal risk of spilling storage element contents while accessing the elements or any one of them.

A further object of this invention is to provide a frame for containment of small hardware items and components wherein surplus household food or utility containers can be used effectively to provide dust-free storage.

It is a further object of this invention to provide a means of fixing a number of storage units into a portable array, capable of being mounted on flat surfaces such as workshop or utility room walls for use as storage cabinets. A further modification would provide for two such arrays joined together and mounted on rollers or casters to serve as a completely mobile small parts storage chest.

A further object of this invention is to provide a means for containment of potted plants wherein access to the plants for pruning and treatment is achieved by pivoting the frame of the invention to its forward position from either a fixed vertical stud mounting or from a wall mounted, semi-portable array.

Another object of this invention is to provide a pivotable storage unit wherein the storage elements are integral parts of the frame, and dust covers, or element tops, are used to cover the elements in the stored condition or position.

Figure 1:
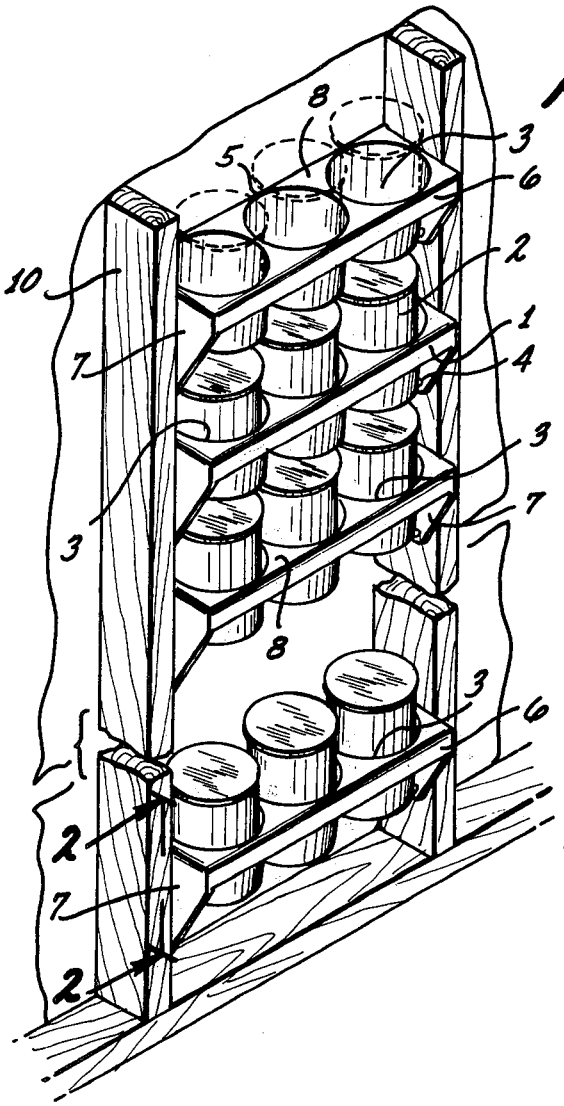
FIG. 1 is an oblique frontal view of an array of storage units, utilizing 1-pound coffee cans or storage elements of similar size.

DETAILED DESCRIPTION OF THE INVENTION:

The invention, as shown in the above-referenced drawings, may include provision for any number of storage elements 2 in the frame 1. Frame 1 may be of any tough, load-bearing material such as sheet metal, wood or plastic. A preferred embodiment of this invention would utilize injection moulding of a suitable plastic for inexpensive production and reliable performance.

The frame 1 has an overall top length $L_1$ of 14⅛ inch and a width, W, at the top, of 5 inch. Frame 1 can have any number of storage element cavities 3, compatible with the overall dimensions $L_1$ and W.

Placement of storage element cavities 3 and storage elements 2 in frame 1 is significant only to the extent that the combined center of volume (and the attendant center of mass) of storage elements 2 is located closer to facing plate 5 than to facing plate 6, i.e., aft of the pivotal axis 4.

Frame 1 has one or more supporting elements 7. The preferred embodiment of this invention utilizes two such elements, one at either extremity, and comprising plates of the frame material inclined at an angle from the perpendicular to the frames' upper surface 8.

Supporting element 7 has pivotal means at axis 4. Such pivotal means 9 can be a simple wood screw device passing through plate 7 and supporting frame 1 through bearing on the external supporting structure 10. Supporting structure 10 is typically 2 inch × 4 inch or 2 inch × 6 inch studs built on 16 inch centers for support of house or garage structures. In use, the frame 1 is supported by the pivotal means 9, and, in variations of the device, the supporting element might well be a plate or multiplicity of plates along the frame, with an axle-type element in place of the wood screw for its pivotal means 9. The axle would similarly mount into supporting structure 10 and bear the load of frame 1 and the contents of its storage elements 2.

Movement of frame 1 about its pivotal axis 4 is controlled by motion-restraint means which could be comprised of pegs in the plates 7, or any suitable location of the frame body, restrained by contact with a cooperating element in the external supporting structure 10. Frame 1 would be permitted to tilt forward, out of its recess in supporting structure 10, until the peg on the frame is restrained by the cooperating restraint member in the supporting structure.

Figure 2:
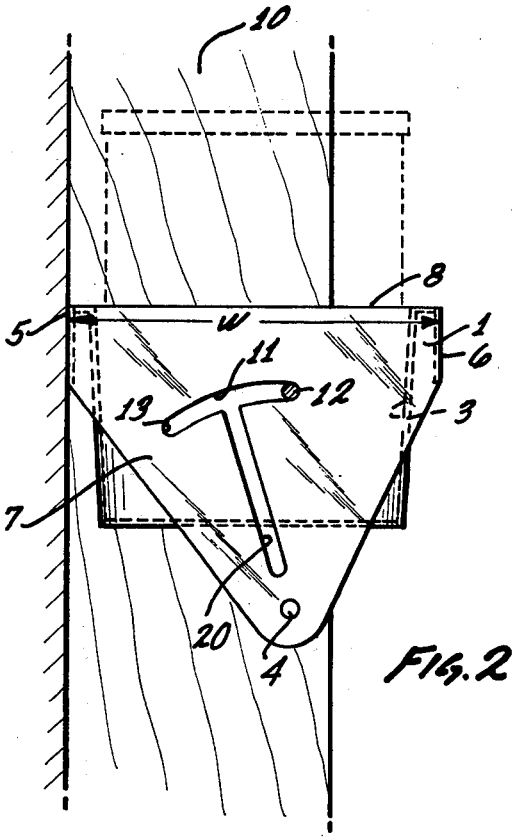
FIG. 2 is an end view of a typical storage unit with the same size storage elements as is shown in FIG. 1.
Figure 3:
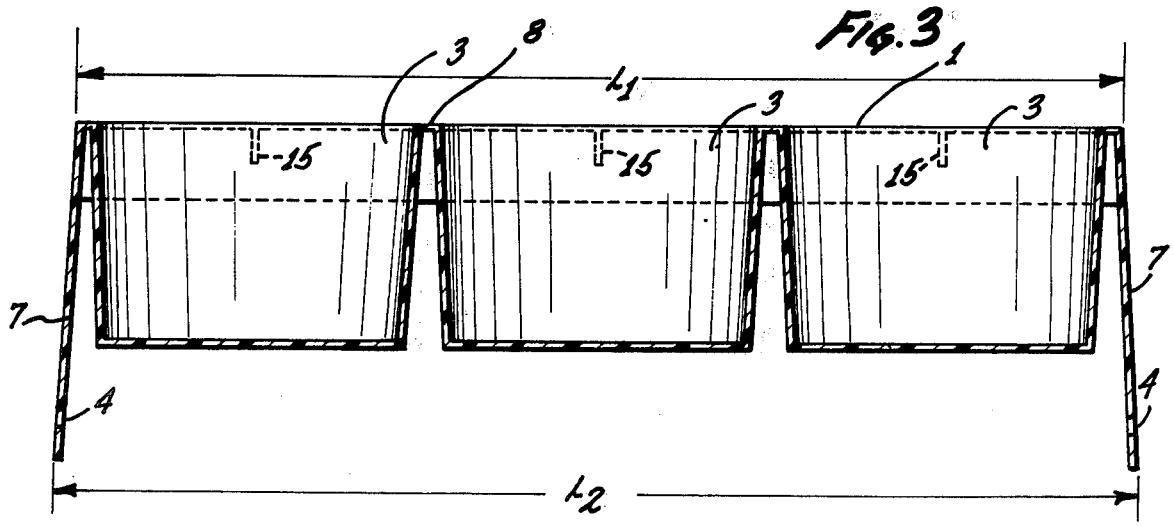
FIG. 3 is a frontal view of the subject storage unit.

In the preferred embodiments presented in FIGS. 2 and 3, a motion-restraint means is employed wherein a lot 11 is cut into one or both of the supporting elements 7, and this slot is arranged to permit rotation about pivotal axis 4 only to the extent that the cooperating peg 12, which is fixed to supporting structure 10, has not come in contact with the edges or limits of slot 11. Slot 11 is so configured that its rearmost edge 13 allows frame 1 to tilt forward about axis 4 until the desired tilt angle 14 is attained for easy access to the storage elements. Slot 11 is bisected by a perpendicular slot 20 to facilitate mounting frame 1 over the motion-restraint means cooperating element 12. Element 12 can then be a wood screw with adjustable length of extension from the supporting structure. Such adjustable allows for irregular spacing of the studs while slot 20 permits capture of element 12 with minimal flexing of the supporting elements 7.

End plates 7, or other variations of support elements, may have any shape compatible with support of the loaded storage elements and connection to the pivotal means. In the preferred embodiment of the invention, end plates 7 are so configured that the pivotal axis 4 is placed approximately one-half inch behind the frontmost edge of the 2 inch × 4 inch supporting structure 10, and 2 inches behind for a 2 × 6 inch structure. Cooperating element 12 of the motion-restraint means is similarly mounted the same distances behind the front edge of the supporting structure, and length of the circular arc slot 11 is adjusted prior to manufacture of the frames to provide an angle 14 of approximately 30°. Equivalent motion-restraint means could be provided in a variety of ways, each employing a reference member in fixed structure to simplify restraint of pivotal travel about axis 4.

Figure 4:
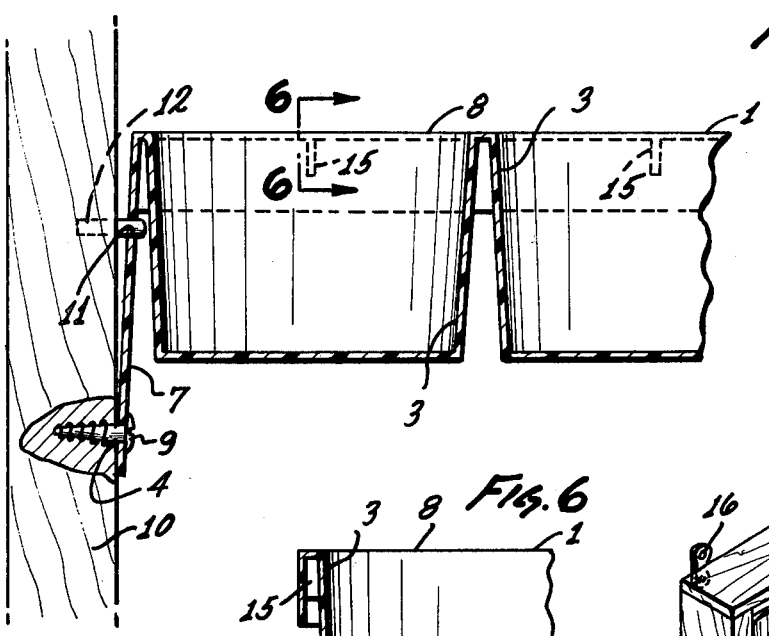
FIG. 4 illustrates one type of pivot means and motionrestraint means mounting.
Figure 6:
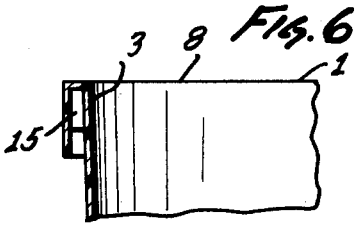
FIG. 6 illustrates the storage element strengthener fillet of the storage unit's frame to storage element case.

The preferred embodiment presented in FIGS. 1 through 8 all utilize end plates 7 and cooperating pegs 12 in the supporting structure. Since frame 1 must be of tough and semi-resilient material, the frame is placed in position by inserting slot 11 over one of the two pegs 12 associated with the specific storage unit. The opposite end plate is then flexed inwardly and the frame pivoted upward until the second peg has engaged slot 20 of that plate, whereupon the plate 7 is unflexed and the pegs 12 are positioned in curved slots 11. Pivotal means 9, here a screw, is inserted into a pivotal axis hole in plate 7 at 4 and, per previously marked location points, secured, pivot-free, to the supporting structure, as shown in FIG. 4.

To provide for variations in spacing between 2 inch × 4 inch studs in their nominal "16 inches between centers" spacing, frame 1 has a top or upper surface dimension $L_1$ of 14⅛ inches. End plates 7 are molded at a slight angle so that they flex relatively close to a nominal 14½ inches. Plates 7 are built so that $L_2$ is a nominal 14½ inches, allowing for flexture over pegs 12. If dimensions of the stud spacing are grossly off the nominal, and still greater than distance $L_1$, various types of shims can be used to extend the pivotal axis of pivotal means 9, and the length of motion-restraint means element 12 can be adjusted through use of a longer peg, or by driving the peg further into the supporting structure where flexing of plates 7 will not permit engagement of peg 12 and slots 20 and 11 (where studs are closer together than nominal, but not closer than $L_1$ inches). In the fabrication of frame 1, provision can be made for extra support of storage element cavities 3 with fillets 15 between cavity bodies and facing plates 5 and 6. Other extra supports could be molded between cavities and bottom plates and storage element support means of a variety of types are within the scope of this invention. Use of molded cavities and specific types of storage elements is introduced for illustrative purposes only and any type of storage element may be used in a frame of this invention. One of the advantges of such a devise, as proposed here, is that it provides a means for storage spacesaving and efficient use of such common expendables as 1-pound coffee cans and baby food jars, both of which have their own removable tops for dust-free storage of small parts.

Figure 7:
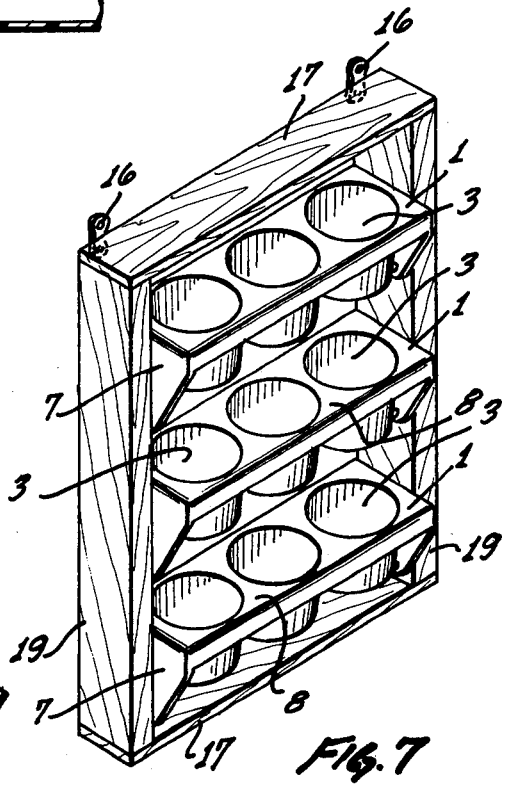
FIG. 7 illustrates use of storage units in a semi-portable array, configured for flat wall mounting.
Figure 5:
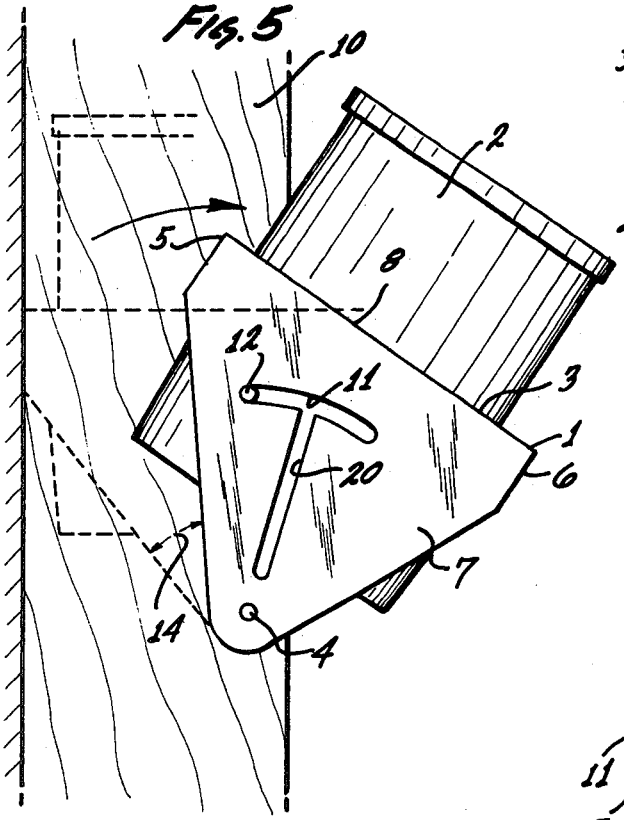
FIG. 5 is an end view of the storage unit in its use positions.
Figure 8:
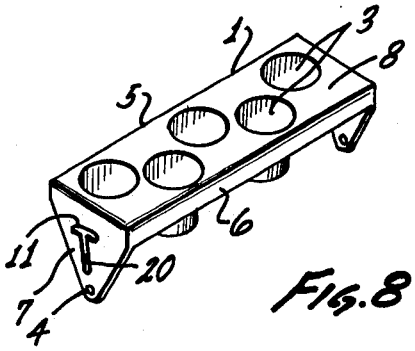
FIG. 8 illustrates a variation of the storage unit utilizing multiple storage cavities as integral parts of the frame (five cavities being illustrated herein).

A variation of storage unit use is shown in FIG. 7. Here, three of the storage units of this invention are mounted between lengths of 2 inch × 4 inches, or appropriately sized framing material 19, with eyelets 16, or other suspension means, to comprise a portable storage array 18, capable of being mounted on flat surfaces or other areas where there is no supporting structure 10 as part of the area in which storage is desired. Appropriate lengths of 2 inch × 4 inch or 2 inch × 6 inch materials, or specially fabricated frame pieces 19 (depending on the number of storage units to be used), are fixed together by braces 17, with eyelets 16 appropriately attached. Supporting pegs in flat wall surfaces at the situs of array 18 usage will allow the array 18 to be used where there are no exposed studs for use of frames 1 alone. Array frame sides 19 then become a complete substitute for supporting structure 10. Two such arrays can be combined and mounted on rollers or casters for use as a completely mobile storage chest.

It is not necessary that additional units, such as storage elements 2, be used with the storage unit of this invention. Variously sized and shaped compartments may be cast or fashioned in the frame and all the advantages of this invention retained for space-saving storage. For dust-free storage without use of additional storage elements, such as 2, dust covers for cavities 3 can be fashioned and removed for access and replaced for storage.

As a further variant of this invention, for use as outside greenery or plant storage, the frames used in semi-portable array 18 could be fitted with cavities 3 having proper drainage holes and be utilized as a compact green or flower plant storage and care unit. Cutting, pruning, watering and care could be accomplished with the frame in its open or rotated position and the frame then rotated back to storage for space-saving in close areas such as walkways or compact patio spaces. Such drainage provisions would not preclude the use of storage elements 2 in some of the cavities 3 with plants or greenery in others.

It is well appreciated that the tiltable storage unit presented herein can be modified in a number of ways to include different means of motion-restraint, variously configured storage compartments and pivotal means, but the essentials of the invention are contained in its adaptablility to utilize presently wasted space between structural 2 inch × 4 inch or 2 inch × 6 inch studs in a convenient, efficient, stowable array of storage elements, tilted into stud recesses when not in use.

In arrays or installations, where a number of storage units are used, a lever and coupling bar may be introduced to activate a multiplicity of them by a simple single motion of the control lever or coupling bar. Such an operating control might prove useful where a specific number of unique combination of storage units is required to be accessed at the same time for certain operations or tasks. The control lever and coupling means are not properly part of this invention, but are disclosed here to indicate other and advantageous uses to which the device claimed herein will respond.

Having described the preferred embodiment of our invention, one skilled in the art could devise other embodiments without departing from the scope of our invention. Our invention, therefore, is not to be limited to the embodiments described herein, but includes all embodiments falling within the spirit and scope of the appended claims.

We claim:

1. In a storage unit comprising frame members pivotally secured to fixed adjacent spaced-apart generally vertical structural support members for limited pivoted travel between a normal generally vertical storage position and a forwardly inclined access position by pivot and motion restraint means comprising a pivot and a coacting arcuate slot and stop pin received therein the improvement comprising:

at least one frame member of a semi-resilient material and sized to generally correspond to the distance between the adjacent spaced-apart support members and having a generally horizontal upper surface including at least an opening adapted to receive a container and including a pair of integral downwardly and outwardly diverging end plate members; and means for enabling assembly of the frame member to the adjacent fixed spaced-apart support members comprising a generally straight slot in each of said end plate members generally normal to and having one end in communication with the arcuate slot and extending linearly toward the pivot for reception of the stop pin for positioning the stop pin in the arcuate slot, whereby said frame member is operatively secured to the fixed spaced-apart support members.

* * * * *